US005686218A

United States Patent [19]

Liebermann et al.

[11] Patent Number: 5,686,218

[45] Date of Patent: Nov. 11, 1997

[54] TONER COMPOSITIONS WITH MODIFIED POLYESTER RESINS

[75] Inventors: George Liebermann, Mississauga; Guerino G. Sacripante, Oakville; Marko D. Saban, Etobicoke; William J. Dale, Scarborough; Richard P. N. Veregin, Mississauga; Maria N. V. McDougall, Burlington; Sheau V. Kao, Oakville, all of Canada

[73] Assignee: Xerox Corporation, Stamford, Conn.

[21] Appl. No.: 586,620

[22] Filed: Feb. 1, 1996

[51] Int. Cl.[6] ..... G03G 9/087

[52] U.S. Cl. ..... 430/109; 430/137

[58] Field of Search ..... 430/106, 109, 430/137

[56] References Cited

U.S. PATENT DOCUMENTS

| | | | |
|---|---|---|---|
| 3,590,000 | 6/1971 | Palermiti et al. | 252/62.1 |
| 4,254,207 | 3/1981 | Landoll et al. | 430/109 |
| 4,525,445 | 6/1985 | De Roo et al. | 430/109 |
| 4,917,983 | 4/1990 | Uchida et al. | 430/109 |
| 4,940,644 | 7/1990 | Matsubara et al. | 430/109 |
| 5,047,305 | 9/1991 | Uchida et al. | 430/110 |
| 5,366,841 | 11/1994 | Patel et al. | 430/137 |

*Primary Examiner*—John Goodrow

*Attorney, Agent, or Firm*—E. O. Palazzo

[57] ABSTRACT

A process which comprises reacting a polyester resin end-capped with hydroxyl moieties or groups with an organic acid anhydride at a temperature of from about 125° C. to about 200° C., thereby resulting in a polyester resin end-capped with acidic moieties or acid groups.

10 Claims, No Drawings

TONER COMPOSITIONS WITH MODIFIED POLYESTER RESINS

BACKGROUND OF THE INVENTION

This invention is generally directed to toner and developer compositions and process thereof, and more specifically, the present invention is directed to a processes for the preparation of polyester resins wherein the end groups of the polyester resin are modified to acid moieties by reaction thereof with organic acids and/or anhydrides, and wherein there results polyester resins with a controlled acid number and wherein the acid number of the polyester can be varied. Also, in embodiments the present invention relates to the preparation of positively, or negatively charged toners with controlled triboelectric charge characteristics and excellent relative humidity sensitivity, and which toners possess rapid admix characteristics. In embodiments, there are provided in accordance with the present invention toner compositions comprised of resin particles, pigment particles, and a polyester with selected acid end groups. More specifically, in embodiments of the present invention, there is provided a toner comprised of pigment particles and a polyester resin containing a controlled number of acid end groups wherein, for example, from about 3 milligrams of potassium hydroxide (KOH) per gram of resin to about 300 milligrams of KOH per gram of resin are selected, and wherein the polyester resin is illustrated by the following formulas:

$$HO\leftarrow R-O_2C-R'-CO_2R\rightarrow_a OH$$

$$HO\leftarrow R-O_2C-R'-CO_2R\rightarrow_b O_2C-R'(CO_2H)_n$$

$$(HO_2C)_nR'-CO_2\leftarrow R'-O_2C-R'-CO_2R\rightarrow_c O_2C-R'(CO_2H)_n$$

wherein R is an alkylene group of from about 2 to about 20 carbon atoms, an alkyleneoxyalkylene group of from about 2 to about 20 carbon atoms or arylene group of from about 6 to about 18 carbon atoms; R' is an alkylene group of from about 2 to about 20 carbon atoms or arylene group of from about 6 to about 18 carbon atoms; n is an integer of at least 1 and preferably is the number 1,2 or 3 in embodiments; and a, b, and c represent the number of repeating segments and each is an integer or number of from about 1 to about 1,000, and embodiments from about 10 to 100 each provided that b or c is at least 1, and, for example, from about 2 to about 100 in embodiments, and that the sum of a, b and c is at least from about 10 to about 1,000, or 10 to about 100 in embodiments. Examples of R that can be selected include, for example, ethylene, propylene, diethylene, butylene, hexylene, ethylene, oxyethylene, propylene, oxypropylene, and mixtures thereof; R' can, for example, be phenylene, isophthalylene, terephthalylene, cydohexylene and mixtures thereof; and the sum of a, b and c is preferably from about 10 to about 100, wherein b or c is at least 5 to about 100.

Polyester resins can be obtained by a melt condensation process by reacting a diacid or diester with an organic diol and a condensation catalyst. The end groups and molecular weight of the polyester resin can be controlled by two methods. In the first method, the monomer ratio of the diacid and diol is varied by a stochiometric imbalance of about 0.90 to about 1.10. If the ratio is about 1.0, then a high polymerization degree of the polyester resins results by controlling the reaction temperature, pressure and time, and the polyester resin is comprised of almost equal amounts of acid and hydroxyl end groups. However, if the stochiometric ratio is greater than 1.0, such as from about 1.01 to about 1.10, then the polymerization degree of the polyester resin is limited, as calculated by the known Flory equations, and the resin is comprised of higher concentrations of acid end groups than hydroxyl end groups. Conversely, if the ratio is less than 1.0, such as from about 0.90 to about 0.99, then the resin is comprised of a higher concentration of hydroxyl end groups than acid end groups. In these processes, the acid number of the polyester is mainly controlled by the stochiometric imbalance of the monomers and is disadvantageous in that high polymerization degree polymers cannot be attained, and furthermore, these processes are limited to acid numbers not greater than two per polymer chain. Furthermore, if one of the monomers is volatile, that is has a boiling point (or vapor pressure) lower than the reaction temperature, it can be removed with the condensate byproduct and a sufficiently high polymerization degree is unattainable. Furthermore, reliable batch to batch reproducibility is poor, and the acid number of the polyester from batch to batch reproducibility can vary from about 20 to about 50 percent. Therefore, not all polyester resins can be obtained by this method, especially those derived from inexpensive aliphatic diols with carbon chains of 2 to about 6, such as ethylene glycol, propylene glycol, butylene glycol, neopentylene glycol, hexylene glycol, diethylene glycol and the like because of their relatively low boiling points ranging from 180° C. to about 240° C. at pressures of from about 0.5 Torrs to about 760 Torrs. In the second method of producing polyester resins by melt condensation process, one of the monomers, usually the diol component, is present in about 1 mole excess equivalent compared to the diacid or diester component such that the stochiometric balance of diol to diacid (or diester) is about 2.0. In this method, it is important that the monomer in excess, preferably the diol component, possesses a boiling of greater than the transesterification temperature of from about 160° C. to about 170° C., and less than about 240° C. to about 260° C. under reduced pressure of from about 0.5 to about 760 Torrs such that the excess monomer can be removed during the polycondensation reaction and polymer degradation is avoided. In this method, high polymerization degree can be obtained and controlled by the reaction conditions and removal of the excess monomer. However, the polyester resins obtained by this latter process are comprised of mainly hydroxyl end groups and not useful for toner compositions wherein polyesters with high acid numbers are necessary.

There is a need for a toner composition comprised of a polyester resin with a controlled acid number, and derived from inexpensive monomers such as aliphatic diols with 2 to 6 carbon atoms. Furthermore, there is a need for a polyester resin with acid end groups in excess of two acid end groups per polymer chain. This invention in embodiments relates to a process for the preparation of a polyester resin with a controlled acid number, and a method for achieving more than two acid end groups per polymer chain, and which process comprises first preparing a polyester resin by the second aforementioned method, and wherein the end groups are comprised of hydroxyl moieties, followed by reacting the resin with an anhydride or acid anhydride such as phthalic anhydride, trimellitic anhydride, succinic acid or maleic anhydride and the like, such that the polyester resin containing the hydroxyl end groups is partially or wholly converted to a polyester resin with acid end groups. In the process of this invention in embodiments, the polyester acid number is controlled by the concentration of acid precursor, such as trimellitic anhydride, succinic acid or maleic anhydride and the like added, such that the acid content is controlled to from about 1 milliequivalent of potassium hydroxide to about 300 milliequivalents of potassium hydroxide per gram of resin. Furthermore, with the processes of the present invention in embodiments the batch to batch reproducibility is less than 20 percent acid content variation. More than two acid end groups per polymer chain are achieved by utilizing acid precursors, such as trimellitic acid or anhydride, of 1,2,4,5-benzene dicarboxylic acid anhydride.

The aforementioned toner compositions and developers thereof, that is the toner mixed with a carrier, display in embodiments a controlled triboelectric charge with excellent admix characteristics and low humidity sensitivity for the toners thereof, which is desired, thus the triboelectric charge is stable to changes in environmental humidity conditions. Copiers and printers equipped with two component developers, that is a toner as one component mixed with the carrier as the other component, can exhibit a positive or negative triboelectric charge with a magnitude of from, for example, about 7 microcoulombs per gram to about 40 microcoulombs per grams. This triboelectric charge permits the toner particles to be transferred to the latent image of the photoreceptor with an opposite charge, thereby forming a toned image on the photoreceptor, which is subsequently transferred to a paper or a transparency substrate, and thereafter subjected to fusing or fixing. In these development systems, it is important for the triboelectric charge to be stable under differing environmental humidity conditions such that the triboelectric charge does not change by more than from about 5 to about 10 microcoulombs per gram. A change of more than from about 5 microcoulombs per gram to about 10 microcoulombs per gram in triboelectric charge of the toner developer can cause nonuniform toned images or result in no toning of the photoreceptor, thus unbalanced density or gray scale is observed in the developed images, or no developed images at all result. Generally, humidity ranges may differ from less than about 20 percent in dry regions to more than about 80 percent in humid regions, and some geographical regions may exhibit fluctuations of up to from about 50 to about 80 percent humidity level within the same day. In such climates, it is important that the developmental triboelectric charge does not change by more than from about 5 microcoulombs per gram to about 10 microcoulombs per gram. As toner resins generally represent from about 80 percent to about 98 percent by weight of the toner, the resin sensitivity to moisture or humidity conditions should be minimized thereby not adversely affecting the triboelectric charge thereof. A number of toner polymeric resins utilized as toner compositions, such as for example styrene-acrylates, styrene-methacrylates, styrene-butadienes, and especially polyesters, reference U.S. Pat. No. 3,590,000, contain from about 0.1 to about 2 percent by weight of moisture, and in some instances, the moisture content of the polyesters may change from about 0.1 to about 4 percent by weight at humidity levels ranging from about 0 to about 100 percent, or preferably from about 20 percent to about 80 percent humidity. These changes in moisture content of the resin may have a dramatic adverse effect on the triboelectric charge of the toner developer. The relative humidity sensitivity of toner is customarily measured by first fabricating a toner comprised of a pigment, optional charge control agent and a resin, then admixing the toner from about 3 percent by weight to about 7 percent by weight with a carrier. The developer composition is then subjected to various humidity levels in a sealed chamber for a finite period of time, such as about 48 hours. The triboelectric charge is then measured for the same developer composition at differing humidity levels and analyzed by several methods, such as graphing the triboelectric charge as a function of humidity level and observing the regions in which dramatic changes occur. Another measuring method comprises dividing the aforementioned graphical interpolation of tribo versus humidity level in three regions, wherein region II is from about 0 to about 30 percent humidity, region III is from about 30 to about 65 percent humidity, and region III is higher than about 65 percent humidity to about 100 percent humidity. Since these measurements are cumbersome and require substantial time, the toner triboelectric charge can be measured after subjecting the toner developer composition to two humidity levels, such as 20 percent humidity and 80 percent humidity, and then calculating the relative sensitivity by taking the triboelectric charge ratio of the 20 to 80 percent humidity as given by the following Equation 1:

$$\text{Relative Humidity Sensitivity} = \frac{\text{Tribo Charge at 20\% } RH}{\text{Tribo Charge at 20\% } RH}$$

wherein RH is the relative humidity.

Thus, if the relative sensitivity is about 1.0, the toner composition is considered nonhumidity sensitive, whereas if the relative sensitivity is greater than from about 3, or greater than about 5, the toner composition is considered to be very humidity sensitive. It is generally believed that a number of polymeric materials exhibit relative sensitivity greater than 1.0, and in general, styrene butadiene, or styrene acrylate possess relative humidity sensitivity of greater than 1.0 and less than about 2.5, whereas polyesters generally possess a relative humidity sensitivity of greater than about 2.5 and less than about 5. Hence, an advantage of the styrene-acrylate or styrene-butadiene crass of resins over polyesters is their lower relative sensitivity. Polyesters are known to display advantages over styrene based resins, such as low fixing temperatures of from about 120° C. to about 140° C., high gloss, such as from about 50 gloss units to about 80 gloss units, and nonvinyl offset properties. Therefore, there is a need for toner compositions comprised of a resin, which possess many of the aforementioned advantages, such as low fixing of from about 120° C. to about 140° C., a high gloss, such as from about 50 gloss units to about 80 gloss units, nonvinyl offset properties, and in addition low relative humidity sensitivity, such as from about 1.0 to about 2.5.

Moreover, in some developer compositions, toners containing the polyester resins of this invention with a controlled number of acid groups such as from about 3 milligrams of potassium hydroxide (KOH) per gram of resin to about 300 milligrams of KOH per gram of resin, can provide excellent admix characteristics of less than 60 seconds without the use of charge control additives. Charge admix characteristics relates to the amount of time it takes a developer comprised of toner and carrier to equilibrate to the desired triboelectric charge when refreshed with more of the same, or similar toner. It is important that the charge admix time be less than 60 seconds and preferably about 30 seconds or less, especially in high volume printing or copying media in order to generate excellent quality prints. It is customary to add charge control agents to the toner compositions to achieve the aforementioned charge admix requirements. However, the use of charge control agents in toner compositions, generally, have other disadvantages, such as increasing the minimum fusing temperatures, and cause deterioration in fuser roll life by chemical interactions, and in some instances add to the cost of the toner. With the present invention in embodiments, the use of the aforementioned polyester resins with controlled acid number for the preparation of toners result in developers with excellent admix characteristics of less than 60 seconds and without the use of charge control additives, and which toners exhibit low fixing of from about 120° C. to about 140° C., high gloss, such as from about 50 gloss units to about 80 gloss units, nonvinyl offset properties, and low relative humidity sensitivity, such as from about 1.0 to about 2.5.

Also, the aforementioned toner compositions usually contain pigment particles comprised of, for example, carbon black like REGAL 330®, magnetites, or mixtures thereof, cyan, magenta, yellow, blue, green, red, or brown components, or mixtures thereof thereby providing for the development and generation of black and/or colored images. The toner compositions of the present invention in embodiments thereof possess excellent admix characteristics as indicated herein, and maintain their triboelectric charging characteristics for an extended number of imaging cycles, up to for example 1,000,000 in a number of embodiments. The toner and developer compositions of the present invention can be selected for electrophotographic, especially xerographic, imaging and printing processes, including color processes.

Certain polyester toner resins are known, reference for example in U.S. Pat. Nos. 3,590,000 and 4,525,445, which illustrate a linear polyester comprised preferably of propoxylated bisphenol A and fumaric acid, and available as SPAR II™ from a number of sources such as Atlas Chemical Company. There is also disclosed in Japanese Patent Laid Open 44836 (1975), 37353 (1982), 109875 (1982) and 3031858-A (1991) and references therein, a linear polyester resin comprised of polybasic carboxylic acid, such as those derived from ethoxylated bisphenol A, cyclohexanedimethanol and terephthalic acid. Further, there is disclosed in U.S. Pat. No. 4,533,614, and, more specifically, U.S. Pat. No. 4,957,774 a linear polyester resin comprised of dodecylsuccinic anhydride, terephthalic acid, alkyloxylated bisphenol A and trimellitic anhydride as chain extenders. These chain extenders or polybasic acids are utilized by charging the monomers at the beginning of the reaction and function as branching or crosslinking agents randomly present on the main chain of the polyester resin. This differs in that, for example, with the process of the present invention there are utilized similar chain extenders or polybasic acids in a subsequent step after the polyester resin with hydroxyl end groups is obtained to convert the end groups to acid end groups in a controlled method, thereby providing for the production of polyester resins with more than two acid end groups per polymer chain, and unattainable, it is believed, by the prior art processes.

Additionally, there is disclosed in U.S. Pat. No. 4,940,644, U.S. Pat. No. 5,047,305, U.S. Pat. No. 4,049,447, and Canadian Patent 1,032,804 a linear polyester comprised of an amorphous aromatic polyester derived from an arylene radical and diol, and specifically resins such as poly (neopentyl-terephthalate) comprised of terephthalate radical and neopentyl glycol. Also, there is disclosed in U.S. Pat. No. 4,525,445 a toner composition comprised of a linear polyester derived from fumaric acid, isophthalic acid and propoxylated bisphenol. Further, other toner compositions with linear polyester resins are disclosed in U.S. Pat. No. 4,968,575, U.S. Pat. No. 5,004,664, which illustrates a linear polyester prepared from the ring opening polymerization of cyclic monomers, and U.S. Pat. No. 5,057,392, which discloses a blend of resins comprised of a crystalline and amorphous polyesters; and U.S. Pat. Nos. 4,543,313 and 4,891,293 wherein there are disclosed linear thermotropic liquid crystalline polyester resins. Other U.S. Patents relating to polyesters are U.S. Pat. Nos. 4,052,325; 3,998,747; 3,909,482; 4,288,516; 4,140,644; 4,489,150; 4,478,423; 4,451,837; 4,446,302; 4,416,965; 4,866,158; 5,153,301; 5,116,713; 5,043,242; 5,045,424; 5,049;646; 5,102,762; 5,110,977 and 4,837;394.

Developer compositions containing modified polyester resins with a polybasic carboxylic acid are known and illustrated in Japanese Laid Open Nos. 44836 (1975); 37353 (1982) and 109875 (1982); and also in U.S. Pat. No. 3,681,106; and branched or crosslinked polyesters derived from polyvalent acids or alcohols are illustrated in U.S. Pat. Nos. 4,298,672; 4,863,825; 4,863,824; 4,845,006; 4,814,249; 4,693,952; 4,657,837; 5,143,809; 5,057,596; 4,988,794; 4,981,939; 4,980,448; 4,960,664; 4,933,252; 4,931,370; 4,917,983 and 4,973,539. The resulting modified polyester resins by branching or crosslinking improve the hot-offset resistance only at a sacrifice of the low fixing temperature performance. In several of the aforementioned prior art references, there are disclosed polyester resins wherein the end groups are either an acid group, wherein acid numbers are reported, or hydroxyl groups. These polyvalent acids are utilized by charging the monomers at the beginning of the reaction and function as branching or crosslinking agents randomly present on the main chain of the polyester resin. With the process of the present invention, in embodiments similar chain extenders or polybasic acids are utilized in a subsequent step after the polyester resin with hydroxyl end group is obtained to convert the end groups to acid end groups in a controlled method, and thereby permitting polyester resins with more than two acid end groups per polymer chain, unattainable, it is believed, by prior art processes.

Also, there is illustrated in U.S. Pat. No. 5,366,841, a toner comprised of pigment particles, optionally a charge control agent, and a polyester resin comprised of alkyl end groups, and wherein excellent dispersibility with waxes is disclosed.

The disclosures of each of the United States patents recited herein are totally incorporated herein by reference.

There is a need for toner compositions which possess desired triboelectric charge levels of, for example, from about 10 to about 40 microcoulombs per gram, and preferably from about 10 to about 25 microcoulombs per gram, and admix charging rates of from about 5 to about 60 seconds, and preferably from about about 15 to about 30 seconds, as determined by the charge spectrograph. There is also a need for low relative humidity toners, such as from about 1.0 to about 2.5 and preferably of from about 1.2 to about 2.2, as calculated by Equation 1, and wherein low minimum fixing temperatures are obtained such as from about 125° C. to about 145° C. with a broad fusing latitude such as from about 30° C. to about 45° C. There is also a need for toner developers with rapid admix characteristics such as less than about 60 seconds and preferably equal to or less than 30 seconds. There is also a need for toner compositions comprised of a resin, a colorant and no charge control additives with many of the aforementioned advantages, and with rapid admix characteristics such as less than about 60 seconds and preferably equal to or less than 30 seconds. There is also a need for toner compositions containing a polyester resin with a controlled number of acid end groups, such as more than 2, process thereof, and polyesters with high acid numbers achievable when more than two acid end groups per polymer chain are present. These and other needs are achievable with the toner composition and process thereof of the present invention.

SUMMARY OF THE INVENTION

It is an object of the present invention to provide toner and developer compositions with certain acid end group polyester resins.

It is another object of the present invention to provide toner and developer compositions with polyester resins with controlled acid end groups, especially polyester resins comprised of more than two and, for example, 3 to 75 acid end groups per polymer chain.

In another object of the present invention there are provided negatively or positively charged toner compositions useful for the development of electrostatic latent images including color images.

In yet another object of the present invention there are provided negatively charged toner compositions containing polyesters prepared by modifying the hydroxyl end groups to acid moieties, or acid groups, and wherein the hydroxyl end groups of the polyester core converted to acid end groups by the reaction of the polyester with known organic anhydrides, such as maleic anhydride phthalic anhydride, and the like.

Also, in another object of the present invention there are provided developer compositions with negatively charged toner particles, and carrier particles.

In yet a further object of the present invention there are provided low humidity sensitive toners, such as for example from about 1.1 to about 2.5.

Also, in yet another object of the present invention there are provided low humidity sensitive toners, such as for example from about 1.1 to about 2.5, with desirable admix properties of 5 seconds to 60 seconds as determined by the charge spectrograph, and preferably less than 15 seconds, for example, and more preferably from about 1 to about 14 seconds, and acceptable triboelectric charging characteristics of from about 10 to about 40 microcoulombs per gram.

Moreover, in another object of the present invention there are provided low humidity sensitive toners with low minimum fixing temperatures, such as from about 125° C. to about 145° C., and which toners contain modified polyesters with end group functionalities, organofluorinated, or siloxy functionalities, and the like; or wherein acid/ester end groups are avoided by careful monomer selection.

Also, in yet another object of the present invention there are provided low humidity sensitive toners with broad fusing latitude, such as from about 30° C. to about 45° C.

Furthermore, in yet another object of the present invention there are provided toner and developer compositions that are useful in a variety of electrostatic imaging and printing processes, including color xerography, and wherein the admix charging times are less than or equal to about 60 seconds.

Another object of the present invention resides in the formation of toners which will enable the development of images in electrophotographic imaging apparatuses, which images have substantially no background deposits thereon, are substantially smudge proof or smudge resistant, and, therefore, are of excellent resolution; and further, such toner compositions can be selected for high speed electrophotographic apparatuses, that is those exceeding 70 copies per minute.

These and other objects of the present invention can be accomplished in embodiments thereof by providing toner compositions comprised of pigment particles, and a polyester resin prepared by modifying the hydroxyl end groups thereof to acid moieties. More specifically, the present invention in embodiments is directed to toner compositions comprised of resin, pigment, or dye, and a polyester prepared by modifying the hydroxyl end groups thereof to acid moieties. Advantages of low humidity sensitivity, rapid admix, appropriate triboelectric characteristics, and the like are achieved with many of the aforementioned toners of the present invention.

Embodiments of the present invention include hydroxyl moieties or groups with an organic acid anhydride at a temperature of from about 125° C. to about 200° C., thereby resulting in a polyester resin endcapped with acidic moieties or acid groups; a process wherein the diacid or diester for preparing said polyester is malonic acid, succinic acid, 2-methyl succinic acid, 2,3-dimethylsuccinic acid, dodecylsuccinic acid, glutaric acid, adipic acid, 2-methyladipic acid, pimelic acid, azeilic acid, sebacic acid, terephthalic acid, isophthalic acid, phthalic acid, 1,2-cyclohexanedioic acid, 1,3-cyclohexanedioic acid, 1,4-cyclohexanedioic acid, glutaric anhydride, succinic anhydride, dodecylsuccinic anhydride, maleic anhydride, fumaric acid, maleic acid, itaconic acid, 2-methylitaconic acid, dialkyl esters, wherein the alkyl groups are of one carbon chain to 23 carbon chains, and are esters of malonate, succinate, 2-methylsuccinate, 2,3-dimethylsuccinate, dodecylsuccinate, glutarate, adipic acid, 2-methyladipate, pimelate, azeilate, sebacate acid, terephthalate, isophthalate, phthalate, 1,2-cyclohexanedioate, 1,3-cyclohexanedioate, 1,4-cyclohexanedioate, or mixtures thereof; and a toner comprised of pigment, and a polyester resin with acidic end groups represented by the following alternative formulas $$HO\left(R-O_2C-R'-CO_2R\right)_a OH$$

$$HO\left(R-O_2C-R'-CO_2R\right)_b O_2C-R'(CO_2H)_n$$

$$(HO_2C)_nR'-CO_2\left(R'-O_2C-R'-CO_2R\right)_c O_2C-R'(CO_2H)_n$$

wherein R is an alkylene, an alkyleneoxyalkylene group or an arylene group; R' is an alkylene or arylene group; n is a number of from 1 to 3; and a, b, and c represent the number of repeating segments, and each is a number of from about 1 to about 1,000 subject to the provision that b or c is at least 1, and that the sum of a, b and c is from about 10 to about 1,000.

The toner compositions of the present invention can be prepared by a number of known methods, such as admixing and heating the polyester resin, pigment particles, such as magnetite, carbon black, or mixtures thereof, and preferably from about 0.5 percent to about 5 percent of the aforementioned polyester in a toner extrusion device, such as the ZSK53 available from Werner Pfieiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns in average volume diameter, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

The process of obtaining the polyester resin with acid end groups involves in embodiments the melt transesterification method wherein a reactor equipped with a mechanical stirrer and distillation apparatus is charged with about 1 mole equivalent of diester, such as dimethylterephthalate, about 2 mole equivalent of an aliphatic glycol or mixture of glycols, such as 1,2-propanediol and diethylene glycol, and about 0.01 mole equivalent of a condensation catalyst such as butylstannoic acid. The mixture is then heated to about 160° C. to 185° C. for a duration of from about three to about six hours whereby the condensate byproduct (methanol) is distilled off into a distillation receiver, after which the reaction mixture is heated to about 200° C., and wherein the pressure is reduced from atmospheric pressure to about 50 Torrs over a 1 hour period, during which time the excess aliphatic diol is removed by distillation. The reaction temperature is then further increased from about 210° to about 220° C., and the pressure reduced further from about 0.1 Torr to about 1 Torr, during which time more of the excess aliphatic diol is collected in the distillation receiver. During this period, the polyester resin product containing hydroxyl end groups is periodically sampled, and its glass transition temperature and softening point is analyzed until the end point is obtained. The reaction is pressurized to atmospheric pressure under an inert atmosphere, such as nitrogen gas, and the reaction temperature cooled to from about 120° C. to about 150° C., after which from about 0.001 to about 0.05 mole equivalent of organic anhydride or acid anhydride is added under stirring to the reaction, and left undisturbed from about 30 minutes to about 2 hours. During this time, it is believed that the polyester resin containing hydroxyl end groups is converted to a polyester resin containing acid end groups by the reaction with an anhydride additive with preferably no change in polymerization degree. It is important in embodiments to retain the reaction temperature at less than 170° C. during or after the addition of the organic anhydride or acid anhydride to avoid cross-transesterification of the polymer chains resulting in branching, and redistribution of polymerization degree. The polyester resin obtained possesses in embodiments a number average molecular weight of from about 2,000 grams per mole to about 100,000 grams per mole, a weight average molecular weight of from about 4,000 grams per mole to about 250,000 grams per mole, and polydispersity of from about 1.8 to about 14, as measured by gel permeation chromatography, and an acid number of from about 1 milliequivalent of potassium hydroxide to about 300 milliequivalent of potassium hydroxide.

Specific examples of diols utilized in preparing the polyesters of the present invention include ethylene glycol, 1,2-propylene glycol, 1,3-propylene glycol, 1,2-butylene glycol, 1,3-butylene glycol, 1,4-butylene glycol, 1,2-pentylene glycol, 1,3-pentylene glycol, 1,4-pentylene glycol, 1,5-pentylene glycol, 1,2-hexylene glycol, 1,3-hexylene glycol, 1,4-hexylene glycol, 1,5-hexylene glycol, 1,6-hexylene glycol, heptylene glycols, octylene glycols, decylene glycol, dodecylene glycol, 2,2-dimethyl propanediol, propoxylated bisphenol A, ethoxylated bisphenol A, 1,4-cyclohexane diol, 1,3-cyclohexane diol, 1,2-cyclohexane diol, 1,2-cyclohexane dimethanol, 2-propanediol, mixtures thereof, and the like; and which glycols are employed in various effective amounts of, for example, from about 45 to about 55 mole percent by weight of the polyester product resin.

Specific examples of diacids or diesters utilized in preparing the polyesters of the present invention include malonic acid, succinic acid, 2-methylsuccinic acid, 2,3-dimethylsuccinic acid, dodecylsuccinic acid, glutaric acid, adipic acid, 2-methyladipic acid, pimelic acid, azeilic acid, sebacic acid, terephthalic acid, isophthalic acid, phthalic acid, 1,2-cydohexanedioic acid, 1,3-cyclohexanedioic acid, 1,4-cyclohexanedioic acid, glutaric anhydride, succinic anhydride, dodecylsuccinic anhydride, maleic anhydride, fumaric acid, maleic acid, itaconic acid, 2-methylitaconic acid, dialkyl esters, wherein the alkyl groups are of one carbon chain to 23 carbon chains, and are esters of malonate, succinate, 2-methylsuccinate, 2,3-dimethylsuccinate, dodecylsuccinate, glutarate, adipic acid, 2-methyladipate, pimelate, azeilate, sebacate acid, terephthalate, isophthalate, phthalate, 1,2-cyclohexanedioate, 1,3-cyclohexanedioate, 1,4-cyclohexanedioate, mixtures thereof, and which components are employed in various effective amounts of, for example, from about 45 to about 55 mole percent by weight of the resin.

Specific examples of polycondensation catalysts are known and can include tetraalkyl titanates, dialkyltin oxide, tetraalkyltin, dialkyltin oxide hydroxide, aluminum arkoxides, alkyl zinc, dialkyl zinc, zinc oxide, stannous oxide, dibutyltin oxide, butyltin oxide hydroxide, tetraalkyl tin, butyl stannoic acid, such as dibutyltin dilaurate, and mixtures thereof, and these catatysts are selected in various effective amounts of, for example, from about 0.01 mole percent to about 1 mole percent of polyester product resin.

Specific examples of organic anhydride or acid anhydrides component for converting the polyester resin with hydroxyl end groups to polyester resins with acid end groups include phthalic anhydride, trimellitic anhydride, succinic anhydride, maleic anhydride, glutaric anhydride, 1,2,4,5-benzenedicarboxylic acid anhydride, mixtures thereof and the like, and this component is selected in various effective amounts of, for example, from about 0.5 percent by weight of resin to about 5 percent by weight of resin.

Numerous well known suitable pigments or dyes can be selected as the colorant for the toner particles including, for example, carbon black like REGAL 330®, nigrosine dye, aniline blue, phthalocyanines, magnetite, or mixtures thereof. A number of carbon blacks available from, for example, Cabot Corporation can be selected. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition.

When the pigment particles are comprised of magnetites, thereby enabling single component magnetic toners in some instances, which magnetites are a mixture of iron oxides ($FeO \cdot Fe_2O_3$) including those commercially available as MAPICO BLACK™, they are present in the toner composition in an amount of from about 10 percent by weight to about 80 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK™, in an amount of, for example, from about 5 to about 60, and preferably from about 10 to about 50 weight percent can be selected.

There can also be blended with the toner compositions of the present invention other toner additives, such as external additive particles including flow aid additives, which additives are usually present on the surface thereof. Examples of these additives include metal oxides like titanium oxide, tin oxide, mixtures thereof, and the like, colloidal fumed silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

Encompassed within the scope of the present invention are colored toner and developer compositions comprised of toner resin particles illustrated herein and optional carrier particles, and as pigments or colorants red, blue, green, brown, magenta, cyan and/or yellow particles, as well as mixtures thereof. More specifically, with regard to the generation of color images utilizing a developer composition with the charge enhancing additives of the present invention, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In embodiments, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles of the present invention are selected to be of a negative or positive polarity enabling the toner particles, which are oppositely charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances, such as carbon black, in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including, for example, KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 and preferably from about 75 to about 200 microns in diameter thereby permitting them to, for example, possess sufficient density and inertia to avoid adherence to the electrostatic images during the development process. The carrier component can be mixed with the toner composition in various suitable combinations, such as from about 1 to 5 parts per toner to about 100 parts to about 200 parts by weight of carrier, are selected.

The toner and developer compositions of the present invention may be selected for use in electrostatographic imaging apparatuses containing therein conventional photoreceptors providing that they are capable of being charged negatively. Thus, the toner and developer compositions of the present invention can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Other similar photoreceptors can be selected providing the objectives of the present invention are achievable.

The toner compositions are usually jetted and classified subsequent to preparation to enable toner particles with a preferred average diameter of from about 5 to about 25 microns, and more preferably from about 8 to about 12 microns. Also, the toner compositions of the present invention preferably possess a triboelectric charge of from about 0.1 to about 2 femtocoulombs per micron in embodiments thereof as determined by the known charge spectrograph. Admix time for the toners of the present invention are preferably from about 5 seconds to 1 minute, and, more specifically, from about 5 to about 15 seconds in embodiments thereof as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

The following Examples are being supplied to further define various species of the present invention, it being noted that these Examples are intended to illustrate and not limit the scope of the present invention. Parts and percentages are by weight unless otherwise indicated. Comparative data are also provided.

EXAMPLE I

A resin comprised of 98 percent by weight of the poly(1,2-propylene-diethylene-terephthalate) resin with hydroxyl end groups and with a 1,2-propylene/diethylene ratio of 75/25 was prepared as follows.

A 2 gallon reactor equipped with a helical stirrer, and a distillation-condensation apparatus was charged with 3.42 kilograms of dimethylterephthalate, 2.346 kilograms of 1,2-propylene glycol, 466 grams of diethylene glycol, and 4.95 grams of butylstannoic acid. The reactor was then heated to about 185° C. for a duration of about 6 hours with stirring at about 150 revolutions per minute. During this time, the byproduct (methanol) was collected in the distillation receiver. The temperature was then increased to about 220° C., and the pressure reduced from atmospheric pressure to about 0.5 Torr over a two hour period. During this time, the excess 1,2-propylene glycol was collected in the distillation receiver. The reaction conditions were then maintained for an additional 90 minutes, after which the reactor was pressurized to atmospheric pressure with nitrogen, and the product discharged through the bottom drain valve of the reactor to yield about 4.5 kilograms of poly(1,2-propylene-diethylene-terephthalate) resin product. This resin product was then characterized as possessing a glass transition temperature of 60.8° C. as measured by the DuPont differential scanning calorimeter, a softening point of 134.5° C. as measured by the Mettier cell point apparatus, a number average molecular weight of 6,800 grams per mole, and a weight average molecular weight of 24,500 grams per mole as measured by gel permeation chromotography using polystyrene as the standard and tetrahydrofuran as the solvent, and an acid number of 0.7 milligram of potassium hydroxide per gram of resin.

EXAMPLES II to V

A series of polyesters with acid ends derived from polyester resins with hydroxyl end groups of Example I, and phthalic anhydride at various weight percent of resin were prepared as follows.

A 2 liter reactor equipped with a mechanical stirrer and bottom drain valve was charged with 800 grams of the Example I polyester resin with hydroxyl end group, and a specified weight of phthalic anhydride (Table 1) was heated to 165° C. for a duration of one hour, followed by discharging the reaction product through the bottom drain valve. The corresponding polyester resins with acid end groups were characterized, and some of their properties thereof are provided in Table 1.

TABLE 1

EXAMPLES II to V

| Example | Phthalic Anhydride (% by weight) | Glass Transition Temperature | Acid Number (mg KOH/g) |
|---|---|---|---|
| II | 0.5 | 59.9 | 3.9 |
| III | 1.0 | 59.6 | 6.7 |
| IV | 1.5 | 57.8 | 8.4 |
| V | 4.0 | 55.1 | 14.6 |

EXAMPLE VI

A polyester resin with acid end groups derived from 98 percent by weight of polyester resin with hydroxyl end groups of Example I, and 2 percent by weight of trimellitic anhydride was prepared as follows.

To a 2 liter reactor equipped with a mechanical stirrer and bottom drain valve was charged with 800 grams of Example I polyester resin with hydroxyl end groups, and 16 grams of trimellitic anhydride. This mixture was heated to 160° C. for a duration of one hour, followed by discharging the reaction product through the bottom drain valve. The resin product was then characterized, and possessed a glass transition temperature of 59.5° C. as measured by the DuPont differential scanning calorimeter, a softening point of 136° C. as measured by the Mettier cell point apparatus, a number average molecular weight of 6,900 grams per mole, and a weight average molecular weight of 24,800 grams per mole as measured by gel permeation chromatography using polystyrene as the standard and tetrahydrofuran as the solvent, and an acid number of 42 milligrams of potassium hydroxide per gram of resin.

EXAMPLE VII

A polyester resin with acid end groups derived from 98 percent by weight of polyester resin with hydroxyl end group of Example I, and 2 percent by weight of succinic anhydride was prepared as follows.

To a 2 liter reactor equipped with a mechanical stirrer and bottom drain valve was charged with 800 grams of the Example VI polyester resin with hydroxyl end groups, and 16 grams of trimellitic anhydride was heated to 160° C. for a duration of one hour, followed by discharging the reaction product through the bottom drain valve. The resin product was then characterized and possessed a glass transition temperature of 59.7° C. as measured by the DuPont differential scanning calorimeter, a softening point of 137° C. as measured by the Merrier cell point apparatus, a number average molecular weight of 6,910 grams per mole, and a weight average molecular weight of 24,750 grams per mole as measured by gel permeation chromatography using polystyrene as the standard and tetrahydrofuran as the solvent, and an acid number of 21 milligrams of potassium hydroxide per gram of resin.

COMPARATIVE EXAMPLE VIII

The resulting polyester resin with hydroxyl end groups of Example I was then fabricated into a black toner comprised of 95 percent resin and 5 percent by weight of REGAL 330™ available from Cabot Chemical Company using the procedure as reported in Example XVII of U.S. Pat. No. 5,391,452, the disclosure of which is totally incorporated herein by reference, that is mixing in an extruder the resin and pigment. After grinding, the toner was measured to display an average volume diameter particle size of 5.2 microns with a geometric distribution of 1.25 as measured by the Coulter Counter. The resulting toner was then utilized without further classification.

A developer composition was prepared by roll milling the aforementioned toner, 3 parts by weight with 100 parts by weight of carrier comprised of a carrier with a steel core 95 microns in diameter, and thereover a coating of KYNAR® polyvinylidene fluoride and polymethylmethacrylate, 60/40 weight percent, and wherein the coating weight is about 1.25 weight percent. The triboelectric charge of this toner was found to be −0.5 microcoulomb per gram. Hence, toners prepared from polyester resin with hydroxyl end groups, and an absence of acid end groups did not charge sufficiently thereby being inferior for electrographic development of toned images. The triboelectric charge for such electrographic development systems should be of from about −2 to about −40 microcoulombs per gram, and preferably of from about −3 to about −20 microcoulombs per gram.

EXAMPLE IX

The resulting polyester resin with hydroxyl end group of Example II was then fabricated into a black toner comprised of 95 percent resin and 5 percent by weight of REGAL 330™ available from Cabot Chemical Company using the procedure as reported in Example VIII. After grinding, the toner was measured to display an average volume diameter particle size of 5.9 microns with a geometric distribution of 1.34 as measured by the Coulter Counter. The resulting toner was then utilized without further classification.

A developer composition was prepared by roll milling the aforementioned toner, 3 parts by weight with 100 parts by weight of carrier comprised of a steel core 95 microns in diameter and thereover a coating of KYNAR® and polymethylmethacrylate, 60/40 weight percent, and wherein the coating weight was about 1.25 weight percent. The triboelectric charge of this toner was found to be −14 microcoulombs per gram. Thus, toners prepared from a polyester resin with acid end groups are very useful in electrographic, especially xerographic, development systems, reference for example U.S. Pat. No. 4,265,990, the disclosure of which is incorporated herein by reference.

EXAMPLE X

The resulting polyester resin with hydroxyl end groups of Example III was fabricated into a black toner comprised of 95 percent resin and 5 percent by weight of REGAL 330™ available from Cabot Chemical Company using the procedure as reported in Example VIII. After grinding, the toner was measured to display an average volume diameter particle size of 6.4 microns with a geometric distribution of 1.25 as measured by the Coulter Counter. The resulting toner was then utilized without further classification.

A developer composition was prepared by roll milling the aforementioned toner, 3 parts by weight with 100 parts by weight of the carrier of Example VII. The triboelectric charge of this toner was found to be −12 microcoulombs per gram.

EXAMPLE XI

The resulting polyester resin with hydroxyl end group of Example IV was fabricated into a black toner comprised of 95 percent resin and 5 percent by weight of REGAL 330™ available from Cabot Chemical Company using the procedure as reported in Example VIII. After grinding, the toner was measured to display an average volume diameter particle size of 5.4 microns with a geometric distribution of 1.28 as measured by the Coulter Counter. The resulting toner was then utilized without further classification.

A developer composition was prepared by roll milling the aforementioned toner, 3 parts by weight with 100 parts by weight of the carrier comprised of Example X. The triboelectric charge of this toner was found to be −11 microcoulombs per gram.

EXAMPLE XII

The polyester resin with hydroxyl end group of Example VI was fabricated into a black toner comprised of 95 percent resin and 5 percent by weight of REGAL 330™ available from Cabot Chemical Company using the procedure as reported in Example VIII. After grinding, the toner was measured to display an average volume diameter particle size of 5.1 microns with a geometric distribution of 131 as measured by the Coulter Counter. The resulting toner was then utilized without further classification.

A developer composition was prepared by roll milling the aforementioned toner, 3 parts by weight with 100 parts by weight of carrier of Example X. The triboelectric charge of this toner was found to be −21 microcoulombs per gram.

Other embodiments and modifications of the present invention may occur to those of ordinary skill in the art subsequent to a review of the present application and the information presented herein; these embodiments and modifications, as well as equivalents thereof, are also included within the scope of this invention.

What is claimed is:

1. A toner comprised of a polyester obtained by a process which comprises reacting a polyester resin endcapped with hydroxyl moieties or groups with an organic acid anhydride at a temperature of from about 125° C. to about 200° C., thereby resulting in a polyester resin endcapped with acidic moieties or acid groups, and pigment.

2. A toner comprised of a polyester obtained by a process which comprises reacting a polyester resin endcapped with hydroxyl moieties or groups with an organic acid anhydride at a temperature of from about 125° C. to about 200° C., thereby resulting in a polyester resin endcapped with acidic moieties or acid groups wherein the polyester rein with acidic or acid end groups is of the following alternative formulas $$HO\left(R-O_2C-R'-CO_2R\right)_a OH$$

$$HO\left(R-O_2C-R'-CO_2R\right)_b O_2C-R'(CO_2H)_n$$

$$(HO_2C)_nR'-CO_2\left(R'-O_2C-R'-CO_2R\right)_c O_2C-R'(CO_2H)_n$$

wherein R is an alkylene, an alkyleneoxyalkylene group or an arylene group; R' is an alkylene or arylene group; n is a number of from 1 to 3, and a, b, and c represent the number of repeating segments and each is a number of from about 1 to about 1,000 subject to the provision that b or c is at least 1, and that the sum of a, b and c is from about 10 to about 1,000; and pigment.

3. A developer comprised of the toner of claim 1 and carrier.

4. A toner consisting essentially of pigment and a polyester resin with acidic end groups represented by the following alternative formulas $$HO\left(R-O_2C-R'-CO_2R\right)_a OH$$

$$HO\left(R-O_2C-R'-CO_2R\right)_b O_2C-R'(CO_2H)_n$$

$$(HO_2C)_nR'-CO_2\left(R'-O_2C-R'-CO_2R\right)_c O_2C-R'(CO_2H)_n$$

wherein R is an alkylene, an alkyleneoxyalkylene group or an arylene group; R' is an alkylene or arylene group; n is a number of from 1 to 3; and a, b, and c represent the number of repeating segments and each is a number of from about 1 to about 1,000 subject to the provision that b or c is at least 1, and that the sum of a, b and c is from about 10 to about 1,000.

5. A developer comprised of the toner of claim 4 and a carrier component.

6. A toner in accordance with claim 1 wherein the resulting polyester endcapped with carboxylic acid moieties has an acid number of from about 1 milliequivalents of acid per gram of resin to about 300 milliequivalents of acid per gram of resin.

7. A toner in accordance with claim 1 wherein the resulting polyester resin endcapped with acid moieties has an acid number of from about 1 milliequivalent of potassium hydroxide per gram of resin to about 300 milliequivalents of potassium hydroxide per gram of resin.

8. A toner in accordance with claim 1 wherein the polyester resin with hydroxyl end groups is obtained by the melt condensation process of one mole equivalent of a diacid or diester with an excess of from about 1.5 to about 3 mole equivalent of an organic diol in the presence of the transesterification catalyst butylstannoic acid, zinc acetate, or titanium (IV) alkyloxide.

9. A toner in accordance with claim 1 wherein the organic acid anhydride is maleic anhydride, phthalic anhydride, trimellitic anhydride, succinic anhydride, glutaric anhydride, dodecyl anhydride, or 1,2,4,5-benzenedicarboxylic acid anhydride.

10. A toner in accordance with claim 8 wherein the diol is ethylene glycol, 1,2-propylene glycol, 1,3-propylene glycol, 1,2-butylene glycol, 1,3-butylene glycol, 1,4-butylene glycol, 1,2-pentylene glycol, 1,3-pentylene glycol, 1,4-pentylene glycol, 1,5-pentylene glycol, 1,2-hexylene glycol, 1,3-hexylene glycol, 1,4-hexylene glycol, 1,5-hexylene glycol, 1,6-hexylene glycol, heptylene glycols, octylene glycols, decylene glycol, dodecylene glycol, 2,2-dimethyl propanediol, propoxylated bisphenol A, ethoxylated bisphenol A, 1,4-cyclohexane diol, 1,3-cyclohexane diol, 1,2-cyclohexane diol, 1,2-cyclohexane dimethanol, 2-propanediol, or mixtures thereof.

* * * * *